US007764256B2

(12) United States Patent
Huang et al.

(10) Patent No.: US 7,764,256 B2
(45) Date of Patent: Jul. 27, 2010

(54) APPARATUS FOR OVERDRIVE COMPUTATION AND METHOD THEREFOR

(75) Inventors: Chung-Hsun Huang, Tainan County (TW); Fung-Jane Chang, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 1141 days.

(21) Appl. No.: 11/325,472

(22) Filed: Jan. 5, 2006

(65) Prior Publication Data

US 2006/0164687 A1 Jul. 27, 2006

(30) Foreign Application Priority Data

Jan. 21, 2005 (TW) ..... 94101912 A

(51) Int. Cl.
*G09G 3/36* (2006.01)

(52) U.S. Cl. ..... 345/89; 345/690

(58) Field of Classification Search ..... 345/84–104, 345/690, 38, 48, 77

See application file for complete search history.

(56) References Cited

U.S. PATENT DOCUMENTS 7,355,580 B2 * 4/2008 Shen et al. ..... 345/98
7,405,741 B1 * 7/2008 Zhang et al. ..... 345/690
7,532,186 B2 * 5/2009 Tsai et al. ..... 345/89
2004/0178984 A1 * 9/2004 Park et al. ..... 345/100
2004/0246224 A1 * 12/2004 Tsai et al. ..... 345/100
2005/0062703 A1 * 3/2005 Lee et al. ..... 345/89
2005/0068343 A1 * 3/2005 Pan et al. ..... 345/690
2005/0146495 A1 * 7/2005 MacKinnon et al. ..... 345/98
2005/0184948 A1 * 8/2005 Halfant ..... 345/98
2005/0219180 A1 * 10/2005 Kubo et al. ..... 345/89
2005/0275646 A1 * 12/2005 Pai et al. ..... 345/204
2006/0050038 A1 * 3/2006 Cheon et al. ..... 345/89
2006/0152535 A1 * 7/2006 Huang et al. ..... 345/690
2006/0209095 A1 * 9/2006 Hsu ..... 345/690

* cited by examiner

*Primary Examiner*—Amare Mengistu
*Assistant Examiner*—Dmitriy Bolotin
(74) *Attorney, Agent, or Firm*—Rabin & Berdo, PC

(57) ABSTRACT

An apparatus for overdrive computation and method therefor. The overdrive computation apparatus is used for generating a desired overdrive gray-level value and includes first and second addition/subtraction devices, a priority encoder, and a computation device. The first addition/subtraction device outputs a difference value indicating difference between a first overdrive gray-level value OD1 and a second overdrive gray-level value OD2. The priority encoder determines a decision signal according to the difference value. The computation device receives first gray-level data, determines a first computation according to the decision signal, and performs the first computation on the first gray-level data to output operated gray-level data. The first gray-level data indicates a value lying between the ith first gray-level index value X(i) and the (i+1)th first gray-level index value X(i+1). The second addition/subtraction device receives the operated gray-level data and the first overdrive gray-level value OD1 to produce the desired overdrive gray-level value.

14 Claims, 6 Drawing Sheets

| | | PF | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| CF | 0 | 0 | 0 | 0 | 0 | 0 | 0 | 0 | 0 | 0 | 0 | 0 | 0 | 0 | 0 | 0 | 0 | 0 |
| | 16 | 16 | 16 | 16 | 8 | 8 | 8 | 8 | 8 | 8 | 6 | 6 | 6 | 8 | 8 | 8 | 8 | 8 |
| | 32 | 50 | 37 | 32 | 16 | 8 | 8 | 8 | 8 | 8 | 8 | 8 | 11 | 8 | 8 | 8 | 8 | 10 |
| | 48 | 96 | 64 | 60 | 48 | 32 | 24 | 24 | 16 | 16 | 16 | 14 | 20 | 8 | 8 | 8 | 8 | 16 |
| | 64 | 120 | 120 | 96 | 72 | 64 | 56 | 48 | 40 | 40 | 32 | 32 | 24 | 16 | 8 | 8 | 10 | 16 |
| | 80 | 172 | 152 | 136 | 96 | 84 | 80 | 72 | 64 | 56 | 56 | 48 | 48 | 40 | 32 | 24 | 16 | 16 |
| | 96 | 144 | 164 | 152 | 120 | 104 | 104 | 96 | 88 | 80 | 72 | 64 | 64 | 56 | 48 | 48 | 40 | 32 |
| | 112 | 192 | 176 | 168 | 136 | 128 | 120 | 120 | 112 | 104 | 96 | 96 | 88 | 80 | 72 | 64 | 56 | 48 |
| | 128 | 208 | 184 | 176 | 168 | 152 | 144 | 136 | 132 | 128 | 120 | 112 | 112 | 104 | 96 | 88 | 80 | 72 |
| | 144 | 168 | 200 | 188 | 176 | 168 | 160 | 160 | 152 | 144 | 144 | 144 | 136 | 128 | 120 | 112 | 104 | 96 |
| | 160 | 184 | 212 | 200 | 192 | 184 | 176 | 176 | 168 | 168 | 160 | 160 | 160 | 152 | 144 | 136 | 136 | 120 |
| | 176 | 224 | 219 | 208 | 200 | 200 | 192 | 192 | 184 | 184 | 184 | 180 | 176 | 168 | 168 | 160 | 160 | 144 |
| | 192 | 230 | 224 | 220 | 216 | 212 | 208 | 208 | 200 | 200 | 200 | 192 | 192 | 192 | 192 | 184 | 176 | 176 |
| | 208 | 236 | 232 | 228 | 228 | 224 | 224 | 224 | 216 | 216 | 216 | 216 | 216 | 210 | 208 | 208 | 200 | 192 |
| | 224 | 243 | 243 | 240 | 240 | 240 | 232 | 232 | 232 | 232 | 232 | 232 | 232 | 228 | 240 | 224 | 224 | 216 |
| | 240 | 248 | 248 | 248 | 248 | 248 | 248 | 248 | 248 | 248 | 248 | 248 | 248 | 240 | 240 | 240 | 240 | 240 |
| | 255 | 255 | 255 | 255 | 255 | 255 | 255 | 255 | 255 | 255 | 255 | 255 | 255 | 255 | 255 | 255 | 255 | 255 |

FIG. 2(PRIOR ART)

APPARATUS FOR OVERDRIVE COMPUTATION AND METHOD THEREFOR

This application claims the benefit of Taiwan application Serial No. 94101912, filed Jan. 21, 2005, the subject matter of which is incorporated herein by reference.

BACKGROUND OF THE INVENTION

1. Field of the Invention

The invention relates in general to a computation apparatus and computation therefor, and more particularly to a computation apparatus and non-linear computations therefor.

2. Description of the Related Art

Liquid crystal displays (LCDs) have been commonly used because of the merit of being thin, light, and having low radiation. Although the LCDs with higher resolutions and display frequencies are being developed, the displays suffer from a bottleneck in responding to voltages applied between liquid crystal layer of the displays. FIG. 1A illustrates this bottleneck in terms of a timing diagram of gray-levels of liquid crystal molecules (LC) when an input voltage is applied to the liquid crystal molecules. FIG. 1B shows a timing diagram of the input voltages. When an input voltage of V1 is applied to the LC, the gray-level of the LC has a value of L1. When an input voltage of V2 is applied to the LC, the gray-level of the LC has a value of L2.

The response of the LC does not keep pace with the change in the input voltage applied. Referring to FIGS. 1A and 1B, when the input voltage changes at time t1 from V1 to V2, the gray-level of the LC changes from L1 to L2. Due to the characteristics of the LC, the transition of the gray-level from L1 to L2 occurs from time t1 to t3, as indicated by a curve C1 in FIG. 1A. From time t4 to t6, the input voltage changes from V2 to V1 so that the gray-level of the LC decreases from L2 to L1, as indicated by a curve C3 in FIG. 1A. However, when the changes in the input voltage become more rapid, as in a display with higher display frequencies and resolutions, the response of the LC will be failed to keep pace with the changes due to the characteristics of the LCD, resulting in a residual effect in displaying frames on the LCD. In order to avoid the residual effect, a method of overdrive has been proposed. At time t1, an overdrive input voltage of V2', instead of the input voltage of V2, is initially employed for driving the LC so that the change of the gray-level from L1 to L2 takes a smaller period from time t1 to t2, as indicated by a curve C2 in FIG. 1A. When the gray-level reaches L2, the voltage applied to the LC is switched from the overdrive input voltage of V2' to the input voltage of V2. Similarly, at time t4, an overdrive input voltage of V1', instead of the input voltage of V1, is initially employed for driving the LC so that the change of the gray-level from L2 to L1 takes a smaller period from time t4 to t5, as indicated by a curve C4 in FIG. 1A. When the gray-level reaches L1, the voltage applied to the LC is switched from the overdrive input voltage of V1' to the input voltage of V1.

When the overdrive voltages of V1' and V2' are employed for driving the LC, the corresponding overdrive gray-level values can be recorded and associated with respective previous gray-level values and current gray-level values to establish an overdrive lookup table. In the lookup table, the previous gray-level values and the current gray-level values are regarded as two kinds of index values, denoted by PF and CF, respectively, and are associated with the corresponding overdrive gray-level values, denoted by OD. An overdrive gray-level value OD can then be determined according to the overdrive lookup table. For example, the previous gray-level index values PF and the current gray-level index values CF for 256 gray-levels result in an overdrive lookup table having 256 by 256 pieces of data for overdrive gray-level values OD. Since such a lookup table has a large amount of data, an overdrive lookup table of a reduced amount of data, for example, 17 by 17, is then derived to reduce the size of an overdrive data generator that includes the overdrive lookup table. FIG. 2 illustrates an overdrive lookup table of 17 by 17.

With a reduced-sized overdrive lookup table, interpolation is additionally required for determining overdrive gray-level values that cannot be directly obtained from the lookup table. FIGS. 3A, 3B, and 3C show three cases that require interpolation. FIG. 3A shows a first case where the previous gray-level index values PF in the overdrive lookup table contain no item matching previous gray-level data PD. For example, the current gray-level data CD and previous gray-level data PD are 64 and 180 respectively. Since the previous gray-level index values PF has no value of 180, interpolation is required for determination of a corresponding overdrive gray-level value A1 of the data CD and PD to drive the LC. FIG. 3B shows a second case where the current gray-level index values CF in the overdrive lookup table contain no item matching current gray-level data CD. For example, the current gray-level data CD and previous gray-level data PD are 70 and 176 respectively. Since the current gray-level index values CF has no value of 70, interpolation is required for determination of a corresponding overdrive gray-level value A2 of the data CD and PD to drive the LC.

In the third case shown in FIG. 3C, both previous gray-level data PD and current gray-level data CD have no corresponding items found in the previous gray-level index values PF and the current gray-level index values CF in the overdrive lookup table. For example, the current gray-level data CD and previous gray-level data PD are 70 and 180 respectively. Since the current gray-level index values CF has no value of 70 and the previous gray-level index values PF has no value of 180, interpolation is required for determination of corresponding overdrive gray-level values A1 and A3 of the data PD and then a desired overdrive gray-level value A4 according to the values A1 and A3 so as to drive the LC with the desired overdrive gray-level value A4.

FIG. 4 illustrates a conventional interpolator. The interpolator 400 includes a subtractor 401, a subtractor 402, a multiplier 403, a shifter 404, and an addition/subtraction device 405. For the first or second case where the gray-level index values F contain no item matching gray-level data D, the subtractor 401 is applied with overdrive gray-level values OD1 and OD2 that respectively correspond to gray-level index values F1 and F2 which come closest to the gray-level data D. The subtractor 401 performs subtraction of the overdrive gray-level values OD1 and OD2 and outputs the difference Q1. The subtractor 402 receives the gray-level data D and the gray-level index value F1, performs subtraction of them, and outputs the difference Q2. The multiplier 403 receives the differences Q1 and Q2 and outputs the production Q3. The shifter 404 receives the production Q3, divides it by 16, and output a result Q4 indicating the integer quotient of the division. The addition/subtraction device 405 receives the result Q4 and the overdrive gray-level value OD1, and outputs an overdrive gray-level value On for driving the LC. For the third case, three times of similar interpolation are required. For the sake of brevity, the third case will not be described in detail. Finally, the interpolator 400 in FIG. 4 achieves a conventional interpolation that can be expressed by: $On=OD1\pm(OD1-OD2)*(D-F1)/(F1-F2)$.

However, the conventional interpolation obtains the overdrive gray-level value On by linear computations. Such interpolation requires a number of multiplication and addition operations, and the multipliers, notably, are complicated, time-consuming, and large-sized computation devices so that it is difficult to meet the requirement of high computation performance and compact size in implementation. Besides, the results of linear interpolation may not be the closest overdrive gray-level values as determined by experiments.

SUMMARY OF THE INVENTION

It is therefore an object of the invention to provide an apparatus for overdrive computation and a method therefor.

The invention achieves the above-identified object by providing an overdrive computation apparatus for generating a desired overdrive gray-level value. The apparatus includes a first addition/subtraction device, a priority encoder, a computation device, and a second addition/subtraction device. The first addition/subtraction device receives a first overdrive gray-level value OD1 and a second overdrive gray-level value OD2, and outputting a difference value indicating difference between the first overdrive gray-level value OD1 and the second overdrive gray-level value OD2. The first overdrive gray-level value OD1 is a corresponding value with respect to an ith first gray-level index value X(i) and a second gray-level index value Y1 in an overdrive lookup table. The second overdrive gray-level value OD2 is a corresponding value with respect to an (i+1)th first gray-level index value X(i+1) and the second gray-level index value Y1 in the overdrive lookup table. The priority encoder determines a decision signal according to the difference value. The computation device receives first gray-level data, determines a first computation according to the decision signal, and performs the first computation on the first gray-level data to output operated gray-level data. The first gray-level data indicates a value lying between the ith first gray-level index value X(i) and the (i+1) th first gray-level index value X(i+1). The second addition/subtraction device receives the operated gray-level data and the first overdrive gray-level value OD1 so as to produce the desired overdrive gray-level value.

The invention achieves another object by providing a computation apparatus including a determining device, a first computation device, and a second computation device. The determining device produces a first decision signal according to a difference between a first gray-level value and a second gray-level value. The first computation device, coupled to the determining device, performs a computation on a third gray-level value according to the decision signal to produce an operated third gray-level value. The second computation device, coupled to the first computation device, produces a desired gray-level value according to the first gray-level value and the operated third gray-level value.

The invention achieves another object by providing a method of generating a desired overdrive gray-level value. The method includes the following steps. First, a difference value between a first overdrive gray-level value OD1 and a second overdrive gray-level value OD2 is determined. The first overdrive gray-level value OD1 is a corresponding value with respect to an ith first gray-level index value (gray-level index value) X(i) and a second gray-level index value Y1 in an overdrive lookup table, and the second overdrive gray-level value OD2 is a corresponding value with respect to an (i+1)th first gray-level index value X(i+1) and the second gray-level index value Y1 in the overdrive lookup table. Next, a decision signal is generated according to the difference value. According to the decision signal, a first computation is determined and the first computation is performed on first gray-level data to output operated gray-level data, wherein the first gray-level data indicates a value lying between the ith first gray-level index value X(i) and the (i+1)th first gray-level index value X(i+1). Finally, the desired overdrive gray-level value is produced according to the operated gray-level data and the first overdrive gray-level value OD1.

The invention achieves another object by providing a computation method including the following steps. A first decision signal is produced according to a difference value between a first gray-level value and a second gray-level value. A computation is the performed on a third gray-level value according to the decision signal to produce an operated third gray-level value. Next, a desired gray-level value is produced according to the first gray-level value and the operated third gray-level value.

Other objects, features, and advantages of the invention will become apparent from the following detailed description of the preferred but non-limiting embodiments. The following description is made with reference to the accompanying drawings.

BRIEF DESCRIPTION OF THE DRAWINGS

FIG. 2 (PRIOR ART) shows an overdrive lookup table of 17 by 17.

DETAILED DESCRIPTION OF THE INVENTION

Figure 1A:
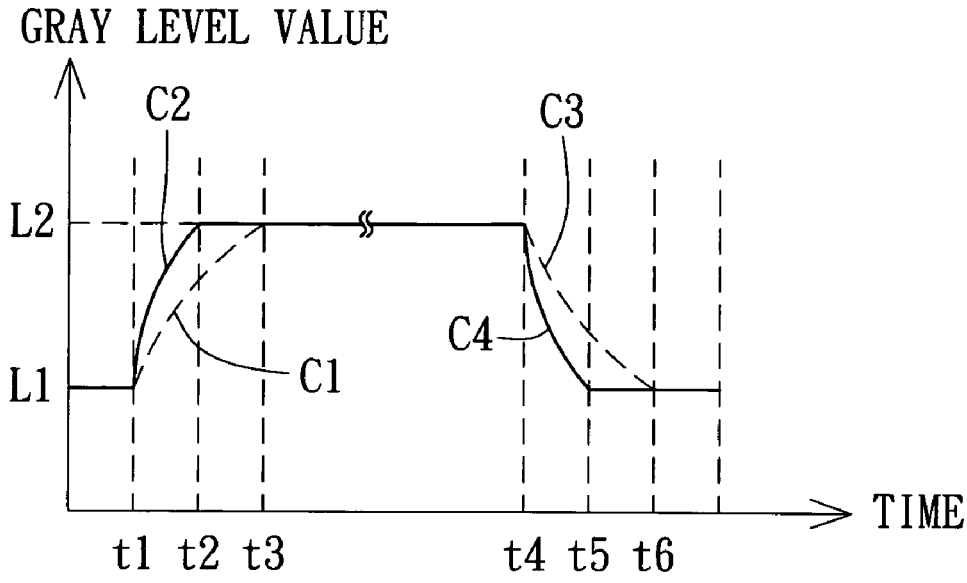
FIG. 1A(PRIOR ART)
FIG. 1A (PRIOR ART) illustrates a timing diagram of gray-levels of liquid crystal molecules.
Figure 1B:
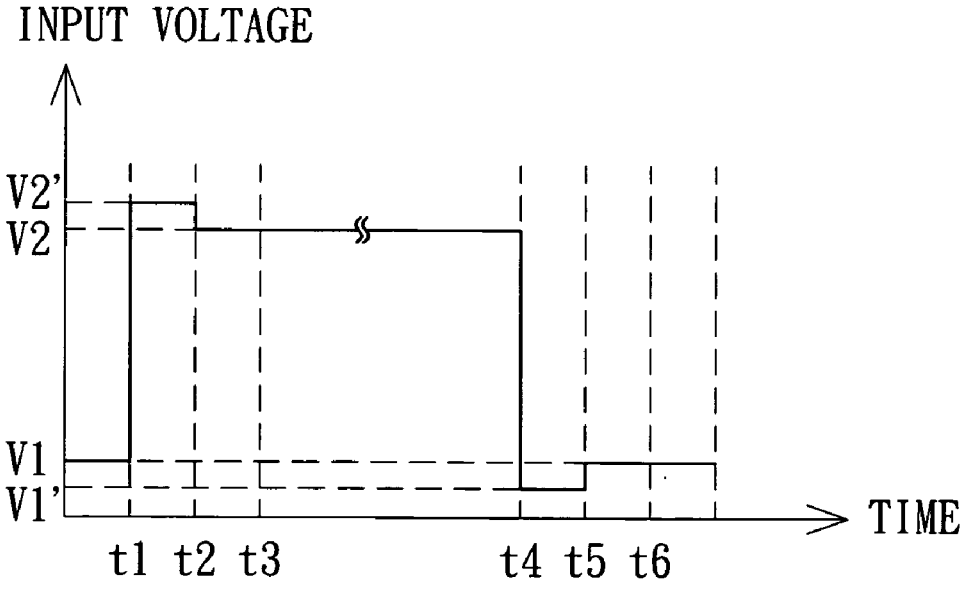
FIG. 1B(PRIOR ART)
FIG. 1B (PRIOR ART) illustrates a timing diagram of input voltages applied to the liquid crystal molecules with respect to FIG. 1A.
Figure 3A:
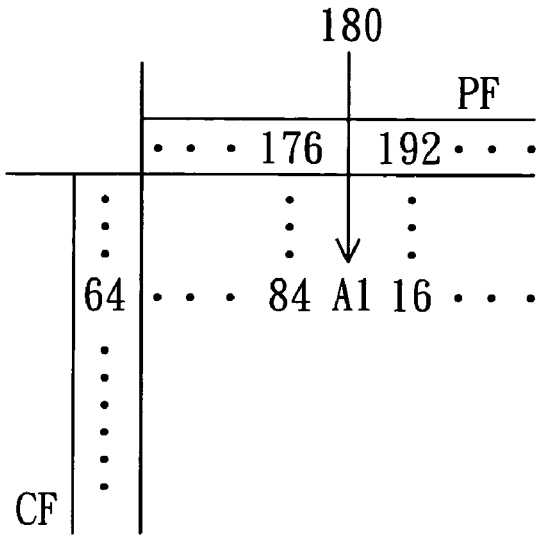
FIG. 3A(PRIOR ART)
FIG. 3A (PRIOR ART) illustrates a first case where interpolation is required.
Figure 3B:
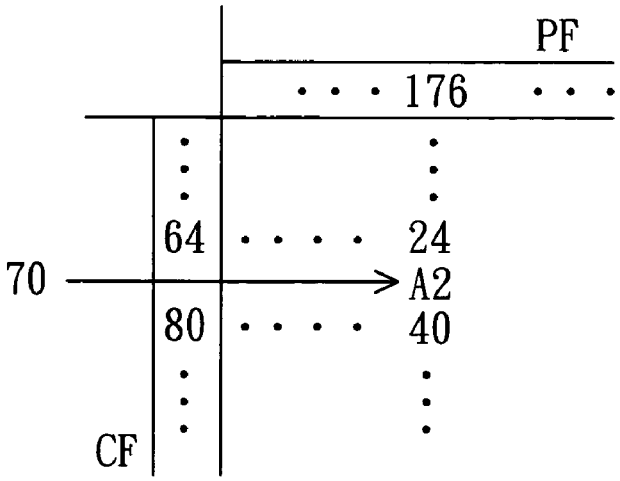
FIG. 3B(PRIOR ART)
FIG. 3B (PRIOR ART) illustrates a second case where interpolation is required.
Figure 3C:
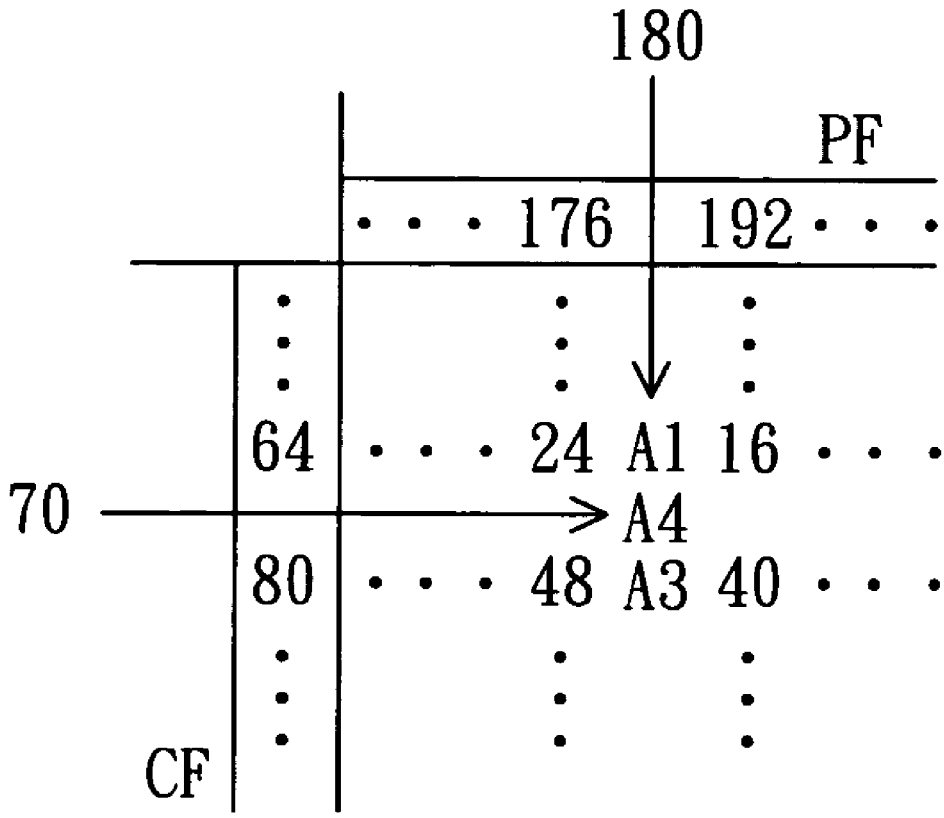
FIG. 3C(PRIOR ART)
FIG. 3C (PRIOR ART) illustrates a third case where interpolation is required.
Figure 4:
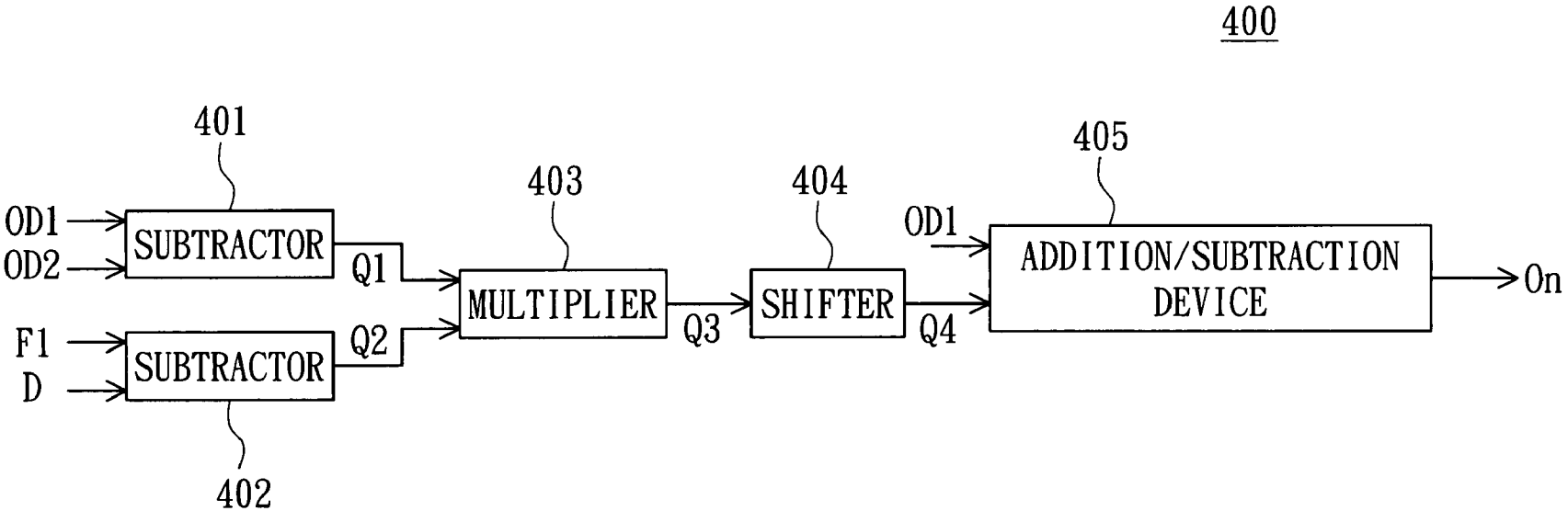
FIG. 4(PRIOR ART)
FIG. 4 (PRIOR ART) is a block diagram illustrating a conventional interpolator.
Figure 5:
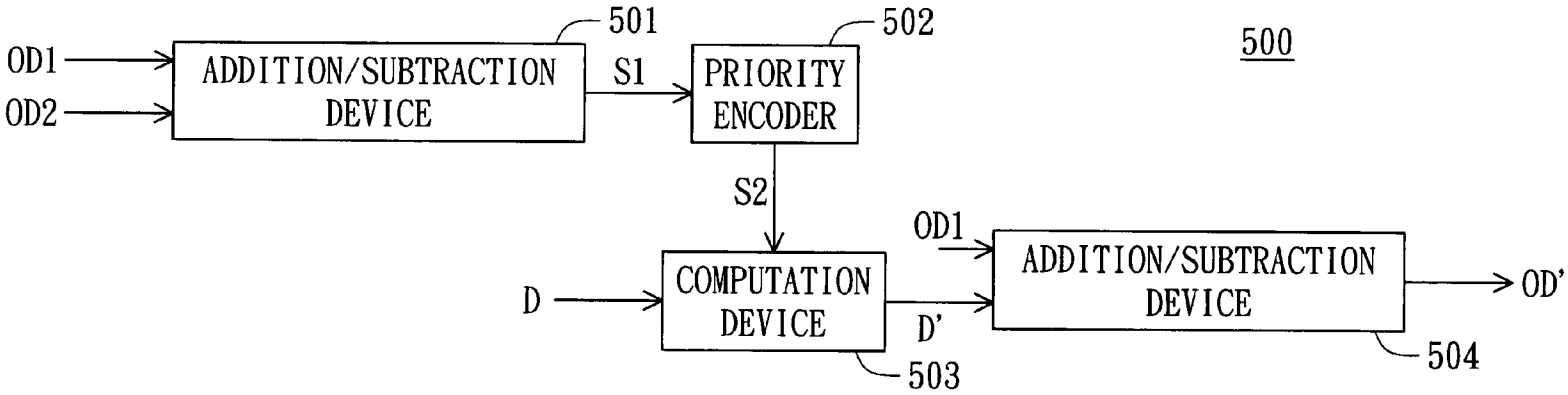
FIG. 5 shows an overdrive computation apparatus according to first to third embodiments of the invention in block diagram form.

FIG. 5 shows an overdrive computation apparatus according to first to third embodiments of the invention in block diagram form. The overdrive computation apparatus 500 includes an addition/subtraction device 501, a priority encoder 502, a computation device 503, and an addition/subtraction device 504. The addition/subtraction device 501 is used for receiving overdrive gray-level value OD1 and overdrive gray-level value OD2 and outputting a difference value S1 between the overdrive gray-level values OD1 and OD2. The priority encoder 502 determines the magnitude of the difference value S1 and outputting a decision signal S2. The computation device 503 receives a signal indicating gray-level data D, determines an computation according to the decision signal S2, performs the computation on the gray-level data D, and then outputs a signal indicating operated gray-level data D'. The addition/subtraction device 504 receives the operated gray-level data D' and the overdrive gray-level value OD1, and outputs an overdrive gray-level value OD'.

For example, in the above-mentioned first case where the previous gray-level index values PF in an overdrive lookup table, such as the one shown in FIG. 2, contain no item matching previous gray-level data PD, the previous gray-level index values PF1 and PF2 that come closest to the previous gray-level data PD are determined, where the value of the previous gray-level data PD lies between the previous gray-level index values PF1 and PF2. The overdrive gray-level value OD1 is a corresponding value of the current gray-level index value CF and the previous gray-level index value PF1 while the overdrive gray-level value OD2 is a corresponding value of the current gray-level index value CF and the previous gray-level index value PF2. In this case, the overdrive gray-level values OD1 and OD2 are recorded in the overdrive lookup table.

Similarly, in the above second case where the current gray-level index values CF in the overdrive lookup table contain no item matching current gray-level data CD, the current gray-level index values CF1 and CF2 that come closest to the current gray-level data CD are determined, where the value of the current gray-level data CD lies between the current gray-level index values CF1 and CF2. The overdrive gray-level value OD1 is a corresponding value with respect to the current gray-level index value CF1 and the previous gray-level index value PF while the overdrive gray-level value OD2 is a corresponding value with respect to the current gray-level index value CF2 and the previous gray-level index value PF.

Next, in the above third case, both previous gray-level data PD and current gray-level data CD have no corresponding items found in the previous gray-level index values PF and the current gray-level index values CF in the overdrive lookup table. The overdrive gray-level values OD1 and OD2 cannot be determined by a lookup in the overdrive lookup table. In this case, a desired overdrive gray-level value OD' can be found by first determining the overdrive gray-level values OD1 and OD2 in the way as in the first and the second cases. The desired overdrive gray-level value OD' can then be determined according to the overdrive gray-level values OD1 and OD2.

The following provides various embodiments according to the invention, which use different computations according to the magnitude of the difference value S1 between the overdrive gray-level values OD1 and OD2.

Embodiment One

In this embodiment, the difference value S1 may lie in different interval, and the relationship between the interval where S1 lies and the overdrive gray-level value OD' is expressed by:

when $S1>64$, $OD'=OD1\pm\{D[3:0]<<2\}$;

when $64>S1>32$, $OD'=OD1\pm\{D[3:0]<<2\}$;

when $32>S1>16$, $OD'=OD1\pm\{D[3:0]<<1\}$;

when $16>S1>8$, $OD'=OD1\pm\{D[3:0]\}$;

when $8>S1>0$, $OD'=OD1\pm\{D[3:0]>>1\}$; and when S1=0, OD'=OD1,where D[3:0] indicates the last four least significant bits (LSBs) of the gray-level data D. During the computation for obtaining the operated gray-level data D', D[3:0] is shifted one or more bits to the left or right and then made to be positive or negative according to the interval where the difference value S1 lies, and the computation of D[3:0] is added to the overdrive gray-level value OD1. For instance, if gray-level data D is previous gray-level data indicating a value of 180. Correspondingly, previous gray-level index values PF1 and PF2 are 176 and 192, respectively, and the current gray-level data and the corresponding current gray-level index value CF are both 80. Therefore, the corresponding overdrive gray-level values OD1 and OD2 are 28 and 16 respectively. After that, the difference value S1 between the corresponding overdrive gray-level values OD1 and OD2 is determined to be 12 and lies between 8 and 16, resulting in D'=D[3: 0]. The decimal number 180 is 10110100b in binary form. D[3:0]=0100b=4 (in decimal) and OD'=OD1±{D[3:0]}=OD1±4=28±4, where a determination has to be made as to whether a positive or negative sign is taken, according to the difference value S1. Since S1=+12 and OD' needs to lie between 28 and 16, OD'=28−4=24. By contrast, the overdrive gray-level value is 25 according to the conventional overdrive computation.

If the gray-level data D is the current gray-level data having a value of 70, the corresponding current gray-level index values CF1 and CF2 are 64 and 80 respectively. If the previous gray-level data is 176, the corresponding previous gray-level index value is also 176. Thus, the overdrive gray-level values OD1 and OD2 are 24 and 48 respectively. The difference value S1 is 24. The current gray-level data is 70 in decimal and is 01000110b in binary form such that {D[3:0]<<1}=1100b=12, and OD'=OD1±{D[3:0]<<1}=OD1±12=24±12. Since S1=−24 and OD' needs to lie between 24 and 48, OD'=24+12=36.

Embodiment Two

This embodiment differs from the first one in operated gray-level data D', wherein the operated gray-level data D' and the overdrive gray-level value OD1 are added to determine a desired overdrive gray-level value OD'. In the second embodiment, the relationship between the interval where S1 lies and the overdrive gray-level value OD' is expressed by:

when $S1>64$, $OD'=OD1\pm\{D[3:0]<<2\}$;

when $64>S1>32$, $OD'=OD1\pm\{D[3:0]<<1\}$;

when $32>S1>16$, $OD'=OD1\pm\{D[3:0]\}$;

when $16>S1>8$, $OD'=OD1\pm\{D[3:0]>>1\}$;

when $8>S1>0$, $OD'=OD1\pm\{D[3:0]>>1\}$; and when S1=0, OD'=OD1.

For instance, if gray-level data D is previous gray-level data indicating a value of 52. Correspondingly, previous gray-level index values PF1 and PF2 are 48 and 64, respectively, and both the current gray-level data and the corresponding current gray-level index value CF are 80. The corresponding overdrive gray-level values OD1 and OD2 are then 96 and 84 respectively. After that, the difference value S1 between the corresponding overdrive gray-level values OD1 and OD2 is determined to be 12 and lies between 8 and 16, resulting in OD'=OD1±{D[3:0]>>1}. The binary form of decimal number 52 is 110100b. D[3:0]=0100b=4 (in decimal) and {D[3:0]>>1} indicates a value obtained by shifting D[3:0] one bit to the right, that is, dividing D[3:0] by 2, such that {D[3:0]>>1}=010b=2 (in decimal); and OD'=OD1±{D[3:0]>>1}=OD1±2=96±2. Next, a determination is made as to whether a positive or negative sign is taken in the above expression, according to the difference value S1. Since S1=+12 and OD' needs to lie between 96 and 84, OD'=96−2=24.

If the gray-level data D is the current gray-level data having a value of 70, the corresponding current gray-level index values CF1 and CF2 are 64 and 80 respectively. The previous gray-level data is 48, the corresponding previous gray-level index value is also 48, and thus the overdrive gray-level values OD1 and OD2 are 72 and 96 respectively. The difference value S1 is 24. The current gray-level data indicating 70 in decimal is 01000110b in binary form such that D[3:0]=110b=6, and OD'=OD1±{D[3:0]}=OD1±6=72±6. Since S1=−24 and OD' needs to lie between 72 and 96, OD'=72+6=78.

Embodiment Three

In the third embodiment, the relationship between the interval where S1 lies and the overdrive gray-level value OD' is expressed by:

when $S1>64$, $OD'=OD1\pm\{D[3:0]<<2\}$;

when 6422 $S1>32$, $OD'=OD1\pm\{(D[3:0]<<1)+(D[3:0]<<2)\}/2$;

when $32>S1>16$, $OD'=OD1\pm\{D[3:0]+(D[3:0]<<1)\}/2$;

when $16>S1>8$, $OD'=OD1\pm\{(D[3:0]>>1)+D[3:0]\}/2$;

when $8>S1>0$, $OD'=OD1\pm\{D[3:0]>>1\}$; and when S1=0, OD'=OD1.

In this embodiment, operated gray-level data D' obtained by using the computations disclosed in the first and the second embodiments are averaged and then the averaged data and overdrive gray-level value OD1 are added together. The positive or negative sign in the expressions is determined in the way as in the above embodiments.

Embodiment Four

In the fourth embodiment, current gray-level data CD and previous gray-level data PD are first compared and the difference value S1 is examined in magnitude so as to determine a computation for calculating the desired result. If PD<=CD, the relationship between the interval where S1 lies and the overdrive gray-level value OD' is expressed by:

when $S1>64$, $OD'=OD1\pm\{D[3:0]<<2\}$;

when $64>S1>32$, $OD'=OD1\pm\{D[3:0]<<1\}$;

when $32>S1>16$, $OD'=OD1\pm\{D[3:0]\}$;

when $16>S1>8$, $OD'=OD1\pm\{D[3:0]>>1\}$;

when $8>S1>0$, $OD'=OD1\pm\{D[3:0]>>1\}$; and when S1=0, OD'=OD1.

If PD>CD, the relationship between the interval where S1 lies and the overdrive gray-level value OD' is expressed by:

when $S1>64$, $OD'=OD1\pm\{D[3:0]<<2\}$;

when $64>S1>32$, $OD'=OD1\pm\{D[3:0]<<2\}$;

when $32>S1>16$, $OD'=OD1\pm\{D[3:0]<<1\}$;

when $16>S1>8$, $OD'=OD1\pm\{D[3:0]\}$;

when $8>S1>0$, $OD'=OD1\pm\{D[3:0]>>1\}$; and when S1=0, OD'=OD1.

If the previous gray-level data PD is 180, the corresponding previous gray-level index values PF1 and PF2 are 176 and 192 respectively. If the current gray-level data CD is 80, the corresponding current gray-level index value CF is also 80. The gray-level data D is equal to the previous gray-level data PD. Since PD is greater in value than CD, that is 180>80, the above-defined expressions with respect to the condition PD>CD are applicable in this case. The overdrive gray-level values OD1 and OD2 are 28 and 16 respectively, and the difference value S1 is 12. Thus, OD'=OD1±D[3:0]=28±4=28−4=24, where the negative sign in this expression is determined according to the criteria in the first and the second embodiments.

If the current gray-level data CD indicates 70, the corresponding current gray-level index values CF1 and CF2 are 64 and 80 respectively. If the previous gray-level data PD indicates 48, the corresponding previous gray-level index value PF is also 48. The gray-level data D is equal to the current gray-level data CD in value. Since PD is smaller than CD in value, that is 48<70, the above-defined expressions with respect to the condition PD<=CD are applicable in this case. The overdrive gray-level values OD1 and OD2 are 72 and 96 respectively, and the difference value S1 is 24. Therefore, OD'=OD1±D[3:0]=72±6=72+6=78, where the positive sign in this expression is determined according to the criteria in the first and the second embodiments.

If the current gray-level data CD indicates 70 and the previous gray-level data PD indicates 180, the corresponding current gray-level index values CF1 and CF2 are 64 and 80 respectively and the previous gray-level index values PF1 and PF2 are 176 and 192 respectively. In this case, three computation steps are needed to produce the desired result. As an example, two overdrive gray-level values OD' are determined by performing two computation steps: (1) taking CD as 70 and PD as 176 and (2) taking CD as 70 and PD as 192, respectively. The desired overdrive gray-level value OD' with respect to CD of 70 and PD of 180 is then determined in the third step according to the two determined overdrive gray-level values OD' in the above two steps. Alternatively, two overdrive gray-level values OD' can be determined by performing two computation steps: (1) taking PD as 180 and CD as 64 and (2) taking PD as 180 and CD as 80. Since the detailed computation is similar to the above embodiments and thus will not be described for the sake of brevity.

Figure 6:
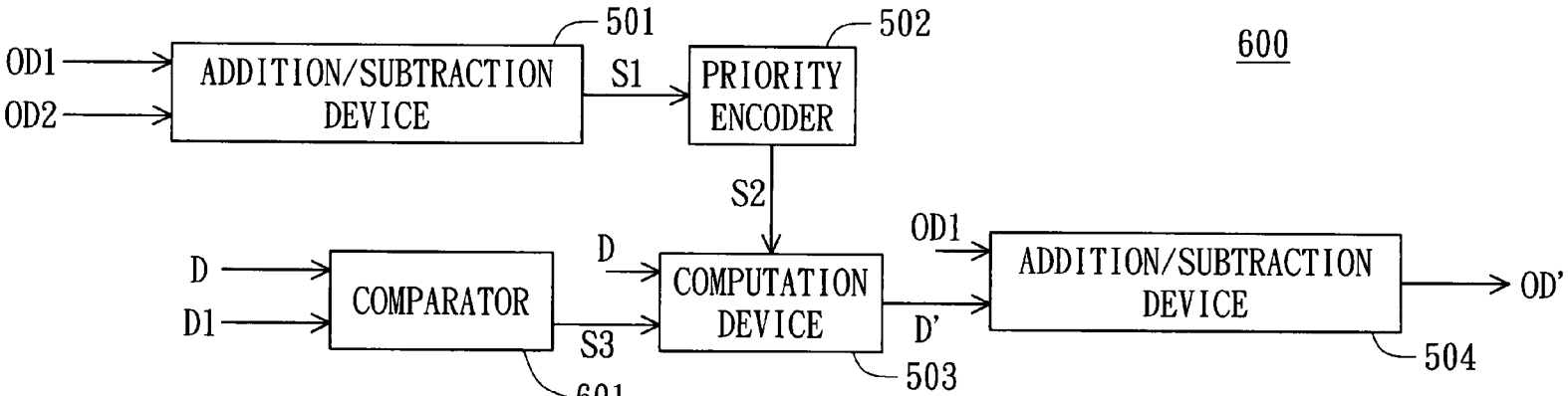
FIG. 6 shows an overdrive computation apparatus according to a fourth embodiment of the invention in block diagram form.

Referring to FIG. 6, an overdrive computation apparatus is shown according to the fourth embodiment of the invention in block diagram form. In comparison with the apparatus 500 in FIG. 5, the overdrive computation apparatus 600 in FIG. 6 further includes a comparator 601. The apparatus 601 is so configured because the overdrive computation according to this embodiment requires comparing previous gray-level data PD and current gray-level data CD. The comparator 601 receives a signal indicating gray-level data D, such as current gray-level data CD, receives a signal indicating gray-level data D1, such as previous gray-level data PD, and then produces a decision signal S3 according to the received data D and D1, for example the difference between the received data D and D1. According to the decision signals S2 and S3, the computation device 503 determines a computation to be performed.

In the above embodiments of invention, the overdrive computation apparatus and the involved computation, which can be regarded as non-linear, are used for interpolation. In another embodiment, they can be used for implementation of extrapolation.

In the above embodiments, the overdrive computation apparatus and the involved computation achieve a simplified overdrive computation and a reduced chip area of circuitry implementing the computation apparatus, as compared with the conventional ones that rely on multipliers for interpolation. In comparison with the results obtained by experiments, the simplified computation produces desired results having less error than those obtained by the conventional interpolation. That is, the above embodiments according to invention can produce results for interpolation with better accuracy.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An overdrive computation apparatus for generating a desired overdrive gray-level value, the apparatus comprising:

a first addition/subtraction device for receiving a first overdrive gray-level value OD1 and a second overdrive gray-level value OD2, and outputting a difference value indicating a difference between the first overdrive gray-level value OD1 and the second overdrive gray-level value OD2, wherein the first overdrive gray-level value OD1 corresponds to an ith first gray-level index value X(i) and a second gray-level index value Y1 in an overdrive lookup table, the second overdrive gray-level value OD2 corresponds to an (i+1)th first gray-level index value X(i+1) and the second gray-level index value Y1 in the overdrive lookup table, the overdrive lookup table includes M first gray-level index values from X(1) to X(M), the ith first gray-level index value X(i) and the (i+1)th first gray-level index value X(i+1) are included in the M first gray-level index values, where i is smaller than M, and i and M are integers, the difference value lies in one of a plurality of intervals, and each of the intervals has a respective corresponding computation for an overdrive gray-level value;

a priority encoder for generating a first decision signal according to the one of the intervals in which the difference value lies;

a computation device for receiving first gray-level data and converting the first gray-level data to operated gray-level data by at least one of a bit-shifting operation and a first adding/subtracting operation, by the respective corresponding computation according to the first decision signal, wherein the first gray-level data indicates a value lying between the ith first gray-level index value X(i) and the (i+1)th first gray-level index value X(i+1); and a second addition/subtraction device, for receiving the operated gray-level data and the first overdrive gray-level value OD1 and for generating the desired overdrive gray-level value by a second adding/subtracting operation on the operated gray-level data and the first overdrive gray-level value OD1.

2. The overdrive computation apparatus according to claim 1, wherein the first gray-level data is either previous gray-level data or current gray-level data.

3. The overdrive computation apparatus according to claim 1, wherein the computation device further includes a comparator, the comparator is for receiving second gray-level data and the first gray-level data, the second gray-level data are gray-level data in a previous computation of the desired overdrive gray-level value or gray-level data in a current computation of the desired overdrive gray-level value while the first gray-level data are the gray-level data in the current computation of the desired overdrive gray-level value or the gray-level data in the previous computation of the desired overdrive gray-level value, respectively, and generating a second decision signal according to the second gray-level data and the first gray-level data, and the computation device generates the operated gray-level data according to the first decision signal and the second decision signal.

4. The overdrive computation apparatus according to claim 1, wherein the operated gray-level data are converted by operating on a portion of bits of the first gray-level data.

5. The overdrive computation apparatus according to claim 1, wherein the desired overdrive gray-level value lies between the first overdrive gray-level value and the second overdrive gray-level value.

6. The overdrive computation apparatus according to claim 1, wherein the first overdrive gray-level value and the second overdrive gray-level value are obtained from a look up table.

7. The overdrive computation apparatus according to claim 1, wherein the desired overdrive gray-level value is used for driving a liquid crystal molecule.

8. A method for generating a desired overdrive gray-level value by using an overdrive computation apparatus, the overdrive computation apparatus comprising a first addition/subtraction device, a priority encoder, a computation device and a second addition/subtraction device, the method comprising:

computing a difference value by the first addition/subtraction device, wherein the difference value indicates a difference between a first overdrive gray-level value OD1 and a second overdrive gray-level value OD2, the first overdrive gray-level value OD1 is a corresponding value with respect to an ith first gray-level index value X(i) and a second gray-level index value Y1 in an overdrive lookup table, the second overdrive gray-level value OD2 is a corresponding value with respect to an (i+1)th first gray-level index value X(i+1) and the second gray-level index value Y1 in the overdrive lookup table, the overdrive lookup table includes M first gray-level index values from X(1) to X(M), and the ith first gray-level index value X(i) and the (i+1)th first gray-level index value X(i+1) are included in the M first gray-level index values, where i is smaller than M, and i and M are integers, the difference value lies in one of a plurality of intervals, and each of the intervals has a respective corresponding computation for an overdrive gray-level value; generating by the priority encoder a first decision signal according to the one of the intervals in which the difference value lies;

converting by the computation device the first gray-level data to operated gray-level data by at least one of a bit-shifting operation and an adding/subtracting operation by the respective corresponding computation according to the first decision signal , wherein the first gray-level data indicates a value lying between the ith first gray-level index value X(i) and the (i+1)th first gray-level index value X(i+1); and generating by the second addition/subtraction device the desired overdrive gray-level value according to the operated gray-level data and the first overdrive gray-level value OD1.

9. The method according to claim 8, wherein the first gray-level data is either previous gray-level data or current gray-level data.

10. The method according to claim 8, further comprises:

receiving second gray-level data, wherein the second gray-level data are gray-level data in a previous computation of the desired overdrive gray-level value or gray-level data in a current computation of the desired overdrive gray-level value while the first gray-level data are the gray-level data in the current computation of the desired overdrive gray-level value or the gray-level data in the previous computation of the desired overdrive gray-level value, respectively;

generating a second decision signal according to the first gray-level data and the second gray-level data; and generating the operated gray-level data according to the first decision signal and the second decision signal.

11. The method according to claim 8, wherein the step of converting by the computation device the first gray-level data to the operated gray-level data further comprises:

selecting a portion of bits of the first gray-level data and converting the first gray-level data to the operated gray-level data by operating on the portion of bits.

12. The method according to claim 8, wherein the desired overdrive gray-level value lies between the first overdrive gray-level value and the second overdrive gray-level value.

13. The method according to claim 8, wherein the first overdrive gray-level value and the second overdrive gray-level value are obtained by looking up a table.

14. The method according to claim 8, further comprising driving a liquid crystal molecule according to the desired overdrive gray-level value.

* * * * *